US006125683A

United States Patent [19]

Toeniskoetter

[11] Patent Number: 6,125,683

[45] Date of Patent: Oct. 3, 2000

[54] CLOSURE PANEL HEMMING SYSTEM

[75] Inventor: James B. Toeniskoetter, Rochester Hills, Mich.

[73] Assignee: Tesco Engineering, Inc., Auburn Hills, Mich.

[21] Appl. No.: 09/436,156

[22] Filed: Nov. 9, 1999

Related U.S. Application Data

[60] Provisional application No. 60/120,824, Feb. 19, 1999.

[51] Int. Cl.[7] ..... B21D 45/00

[52] U.S. Cl. ..... 72/426; 72/361; 72/422; 72/374; 414/752

[58] Field of Search ..... 72/344, 361, 405.09, 72/405.1, 405.12, 405.13, 419, 420, 421, 422, 426, 374, 379.2; 414/222, 225, 627, 752

[56] References Cited

U.S. PATENT DOCUMENTS 5,363,683 11/1994 Thudium et al. ..... 72/405.1
5,388,952 2/1995 Hofele et al. ..... 414/752
5,584,205 12/1996 Harsch et al. ..... 72/405.02
5,727,415 3/1998 Alitalo ..... 72/422

*Primary Examiner*—Ed Tolan
*Attorney, Agent, or Firm*—Fildes & Outland, P.C.

[57] ABSTRACT

A hemming system includes a hemming machine having upper and lower dies moveable between an open spaced apart position and closed hemming position. The upper die includes an engager operative for engaging a part thereon. A robot having a moveable arm with an end effector including lower and upper engagers on lower and upper surfaces thereof; the robot arm being operable to pick up a first part with the lower engager, place the part on the lower die and clear the hemming machine. The hemming machine is operable to close the upper and lower dies to hem the first part. The engager on the upper die is operable to engage the first hemmed part on the upper die as the dies are opened. The robot arm is operable to pick up a second part with the lower engaging means, place the part on the lower die, raise, and engage the first hemmed part on the upper engaging means. The engager on the upper die is operable to disengage the first hemmed part, whereby the first hemmed part and robot arm can be cleared of the hemming machine and the upper and lower dies cycled to hem the second part.

9 Claims, 3 Drawing Sheets

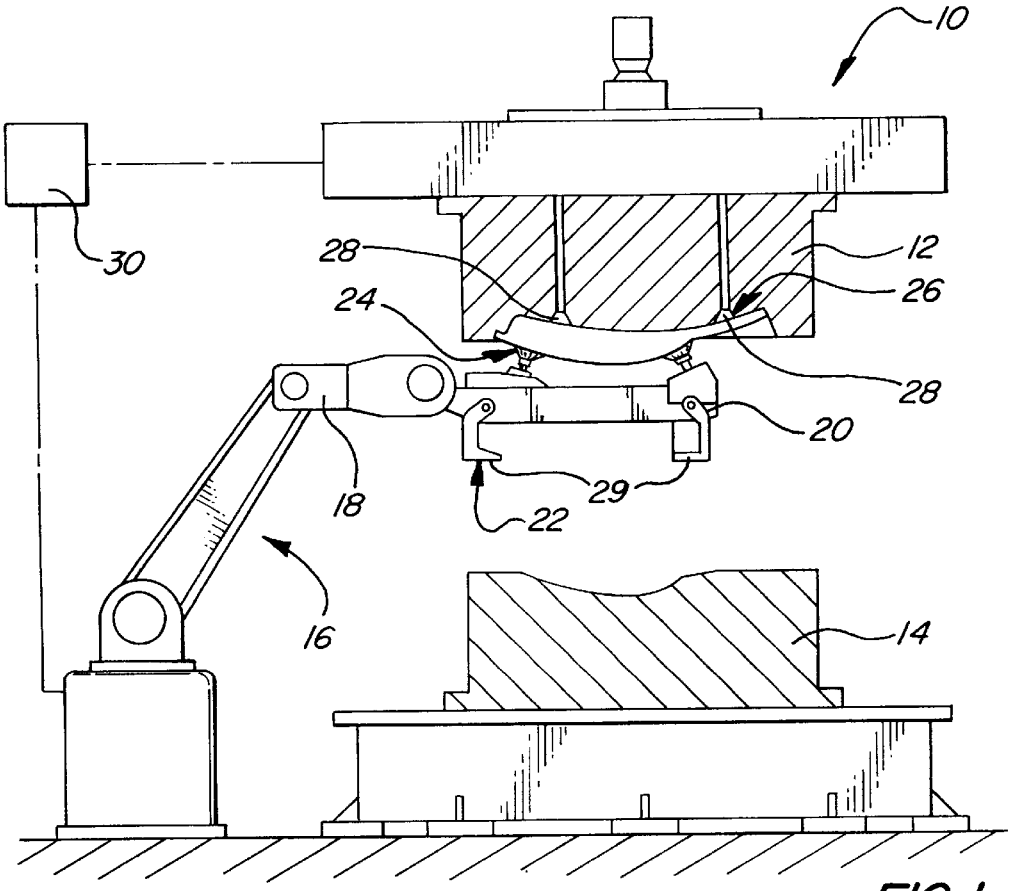
FIG-1
FIG-2
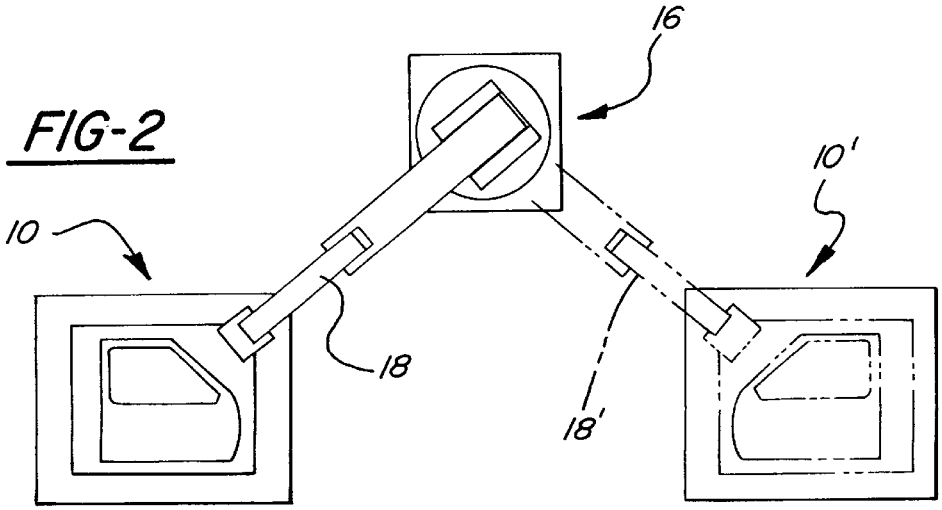

CLOSURE PANEL HEMMING SYSTEM

CROSS REFERENCE TO RELATED APPLICATIONS

This application claims the benefit of U.S. Provisional Application Ser. No. 60/120,824, filed Feb. 19, 1999.

FIELD OF THE INVENTION

This invention relates to hemming vehicle closure panels and, more particularly, to an improved method and system for moving parts into and out from a hemming machine.

BACKGROUND OF THE INVENTION

Conventional production closure panel hemming operations utilize a belt conveyor for transferring parts, nested metal panels, into and out from a hemming machine. In such an operation, there is little flexibility as part flow is limited to inline flow, both sides of the hemming machine must be open and accessible, a drop stop is used to stop the part along the conveyor for hemming and a lifter is required to get the hemmed part back on the belt conveyor. In addition, there is significant cost associated with the belt units, drop stop, and lifter.

The present invention provides flexibility of part flow, reduces cycle time, and provides cost savings.

SUMMARY OF THE INVENTION

The present invention provides a method and hemming system that utilizes a robot to move parts into and out from one or more hemming machines, thereby eliminating conventional belt conveyor transfer and increasing the flexibility and efficiency of the part transfer.

Accordingly, this invention provides a method of moving parts into and out from a hemming machine having upper and lower dies moveable between an open spaced apart position and closed hemming position. The method comprises the steps of providing a robot having a moveable arm with an end effector including lower and upper engaging means on lower and upper surfaces thereof; picking up a first part with the lower engaging means and placing the part on the lower die; clearing the hemming machine of the robot arm; closing the upper and lower dies to hem the first part; engaging the first hemmed part on said upper die and opening said dies; picking up a second part with the lower engaging means and placing it on the lower die; raising the robot arm and engaging the first hemmed part on the upper engaging means; releasing said first hemmed part from said upper die; clearing the hemming machine of the first hemmed part and robot arm; and cycling the upper and lower dies to hem the second part.

A hemming system in accordance with the present invention includes a hemming machine having upper and lower dies moveable between an open spaced apart position and closed hemming position. The upper die includes engaging means operative for engaging a part thereon. A robot adjacent the hemming machine having a moveable arm with an end effector including lower and upper engaging means on lower and upper surfaces thereof; the robot arm being operable to pick up a first part with the lower engaging means, place the part on the lower die and clear the hemming machine. The hemming machine is operable to close the upper and lower dies to hem the first part. The engaging means on the upper die is operable to engage the first hemmed part on the upper die as the dies are opened. The robot arm is operable to pick up a second part with the lower engaging means, place the part on the lower die, raise, and engage the first hemmed part on the upper engaging means. The engaging means on the upper die is operable to disengage the first hemmed part, whereby the first hemmed part and robot arm can be cleared of the hemming machine and the upper and lower dies cycled to hem the second part.

These and other features and advantages of the invention will be more fully understood from the following detailed description of the invention taken together with the accompanying drawings.

BRIEF DESCRIPTION OF THE DRAWINGS

In the drawings:

FIG. 1 is a schematic elevational view of a hemming machine having upper and lower dies and a robot having a moveable arm with an end effector including lower and upper engaging means for moving parts into and out from the hemming machine;

FIG. 2 is a schematic plan view illustrating the use of the robot with two hemming machines;

DETAILED DESCRIPTION OF THE INVENTION

Figure 3:
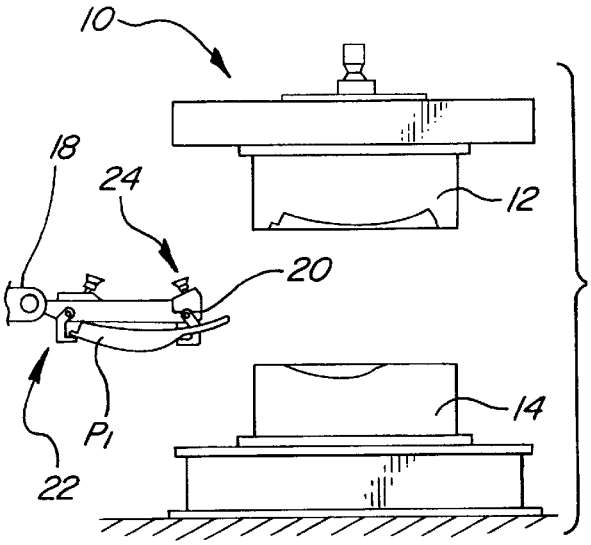
FIG. 3 is a schematic elevational view illustrating spaced upper and lower dies and the end effector supporting a part on lower engaging means.

Referring to FIG. 1, there is shown a hemming machine 10 including an upper die 12 and lower die 14. Upper and lower dies 12, 14 are moveable between an open spaced apart position, FIGS. 3–5 and 7–10, and a closed hemming position, FIG. 6. A robot 16, adjacent the hemming machine 10, includes a moveable arm 18 having an end effector 20 including lower and upper engaging means 22, 24 for engaging a part P thereon. Herein for illustration, part P is a vehicle door comprised of nested inner and outer metal panels.

Figure 4:
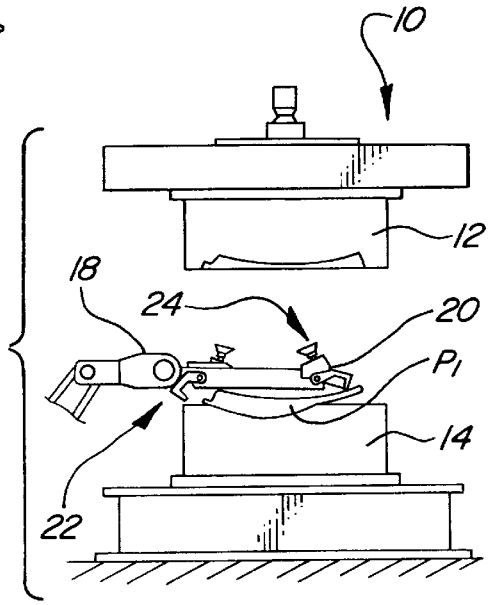
FIG. 4 is a schematic elevational view illustrating the supported part being deposited on the lower die.
Figure 5:
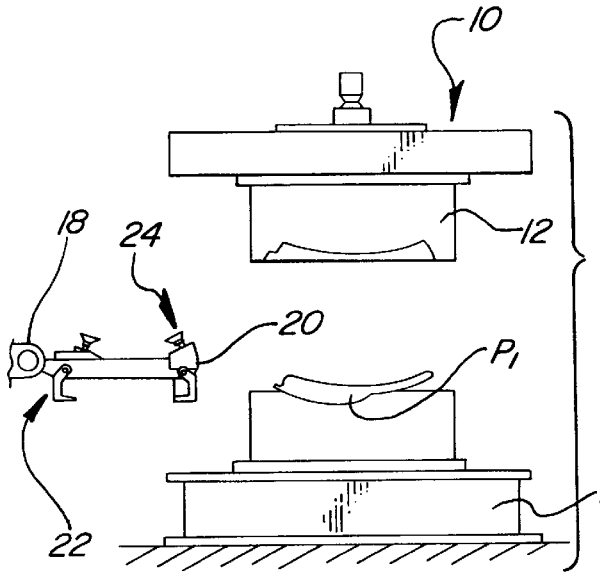
FIG. 5 is a schematic elevational view illustrating the robot arm clearing the hemming machine before the upper and lower dies are brought together for hemming.
Figure 6:
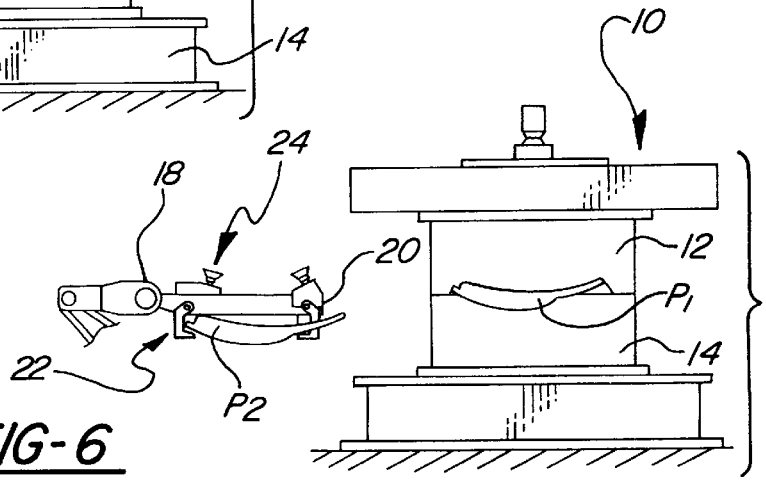
FIG. 6 is a schematic elevational view illustrating the upper and lower dies in a closed part hemming position and the end effector supporting a subsequent part on the lower engaging means.

With reference to FIGS. 3–10, robot arm 18 is operable to pick up a first part $P_1$ with lower engaging means 22, FIG. 3, place part $P_1$ on the lower die 14, FIG. 4, and clear the hemming machine, FIG. 5. The hemming machine 10 is operable via controller 30, illustrated in FIG. 1, to close the upper and lower dies 12, 14 to hem part $P_1$ as illustrated in FIG. 6.

Figure 7:
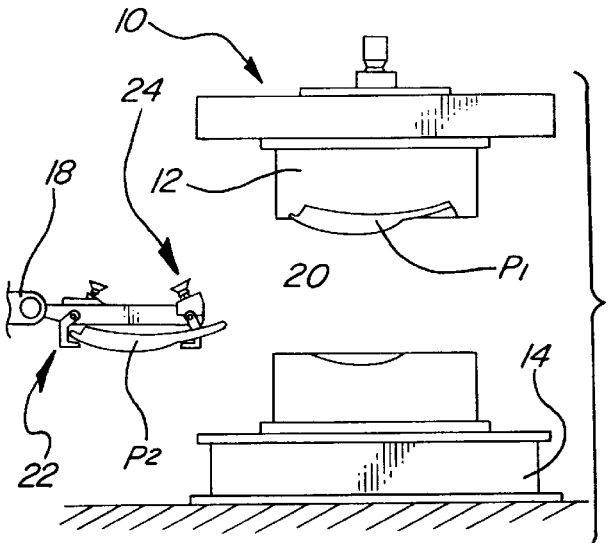
FIG. 7 is a schematic elevational view illustrating the upper and lower dies moved to a spaced position, the hemmed part being retained on the upper die and the subsequent part on the lower engaging means.
Figure 8:
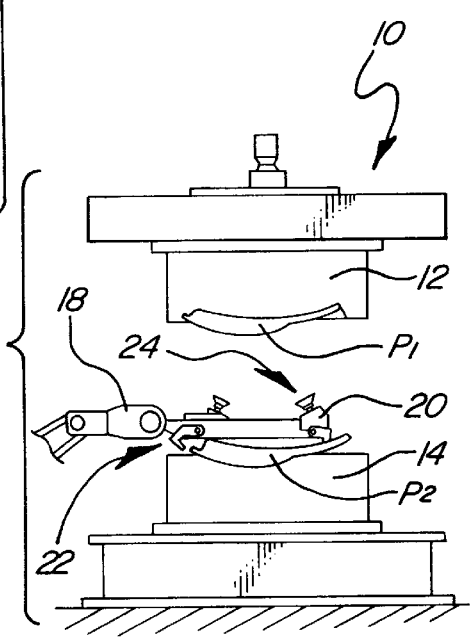
FIG. 8 is a schematic elevational view illustrating the subsequent part being deposited on the lower die and the previous now hemmed part being retained on the upper die.
Figure 9:
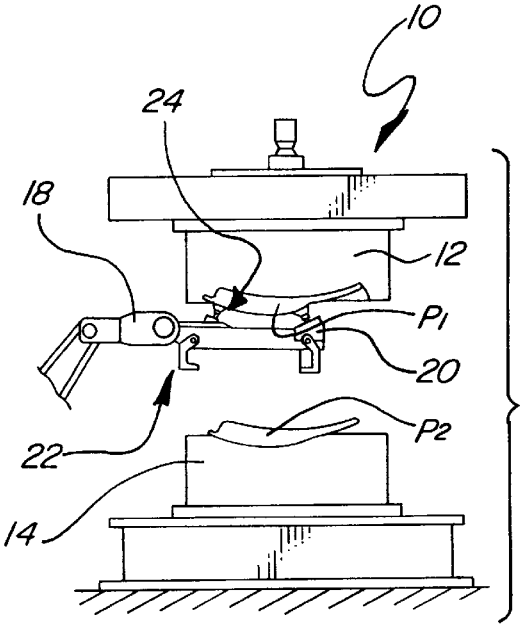
FIG. 9 is a schematic elevational view illustrating the end effector upper engaging means capturing the hemmed part retained in the upper die.
Figure 10:
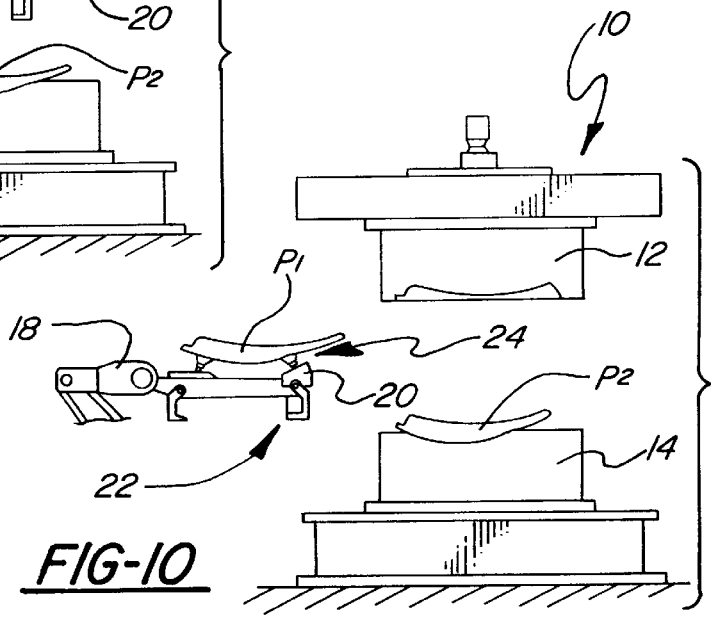
FIG. 10 is a schematic elevational view illustrating the robot arm clearing the hemming machine and removing the hemmed part.

Referring to FIG. 1, the upper die 12 is provided with engaging means 26 illustrated as vacuum suction cups 28 that are operable to engage the now hemmed part $P_1$ on the upper die as the dies 12, 14 are opened, FIG. 7.

While part $P_1$ is being hemmed, robot arm 18 is operable to pick up a second part $P_2$ with lower engaging means 22. After part $P_1$ is hemmed and the upper and lower dies 12, 14 are separated, second part $P_2$ is placed on the lower die 14 and released from the lower engaging means 22. Thereafter, robot arm 18 is raised, FIG. 9, to allow the upper engaging means 24 to engage hemmed part $P_1$.

The engaging means 26 on the upper die is then operated to disengage hemmed part $P_1$ and the robot arm 18 is cleared of the hemming machine so the upper and lower dies 12, 14 can be cycled to hem the subsequent part $P_2$.

Lower engaging means 22 are illustrated as a mechanical clamping device having pivoting clamping fingers 29. Lower engaging means 22 may also be comprised of pneumatic suction cups or magnetic pick-ups. The engaging means 24 and 26 are pneumatic suction cups, although magnetic pick-ups or mechanical clamping devices could be utilized.

With further reference to FIG. 1, controller 30 in communication with hemming machine 10 and robot 16 controls the operation of the hemming machine and robot.

Referring to FIG. 2, robot 16 is illustrated serving two hemming machines 10 which provide additional efficiencies as one robot and one controller 30 operate two hemming machines.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A method of moving parts into and out from a hemming machine having upper and lower dies moveable between an open spaced apart position and closed hemming position;

the method comprising the steps of:

providing a robot having a moveable arm with an end effector including lower and upper engaging means on lower and upper surfaces thereof;

picking up a first part with said lower engaging means and placing the part on said lower die;

clearing said hemming machine of said robot arm;

closing said upper and lower dies to hem said first part;

engaging said first hemmed part on said upper die and opening said dies;

picking up a second part with said lower engaging means and placing it on said lower die;

raising said robot arm and engaging said first hemmed part on said upper engaging means;

releasing said first hemmed part from said upper die;

clearing said hemming machine of said first hemmed part and robot arm; and cycling said upper and lower dies to hem the second part.

2. The method of claim 1 comprising the step of providing a controller for controlling the operation of said hemming machine and robot.

3. A hemming system comprising:

a hemming machine having upper and lower dies moveable between an open spaced apart position and a closed hemming position;

said upper die including engaging means operative for engaging a part thereon;

a robot having a moveable arm with an end effector including lower and upper engaging means on lower and upper surfaces thereof;

said robot arm being operable to pick up a first part with said lower engaging means, place the part on said lower die and clear said hemming machine;

said hemming machine being operable to close said upper and lower dies to hem said first part;

said engaging means on said upper die being operable to engage said first hemmed part on said upper die as said dies are opened;

said robot arm being operable to pick up a second part with said lower engaging means, place the part on said lower die, raise, and engage said first hemmed part on said upper engaging means;

said engaging means on said upper die being operable to disengage said first hemmed part;

whereby said first hemmed part and robot arm are cleared of said hemming machine and said upper and lower dies cycled to hem the second part.

4. The system of claim 3 including a controller for controlling the operation of said hemming machine and robot.

5. The system of claim 3 including a second hemming machine associated with said robot.

6. The system of claim 5 including a controller for controlling the operation of both said hemming machines and robot.

7. The system of claim 2 wherein said upper die engaging means are suction cups.

8. The system of claim 2 wherein said end effector upper engaging means are suction cups.

9. The system of claim 8 wherein said end effector lower engaging means are mechanical clamping devices.

* * * * *